United States Patent [19]

Kelly

[11] Patent Number: 4,806,384

[45] Date of Patent: Feb. 21, 1989

[54] PROCESS FOR FORMING EXOERGIC STRUCTURES WITH THE USE OF A PLASMA

[75] Inventor: Michael D. Kelly, West Alexandria, Ohio

[73] Assignee: The United States of America as represented by the United States Department of Energy, Washington, D.C.

[21] Appl. No.: 55,219

[22] Filed: May 29, 1987

[51] Int. Cl.[4] ..... B05D 3/06; B32B 9/00; B32B 19/00

[52] U.S. Cl. ..... 427/34; 428/689; 428/697

[58] Field of Search ..... 427/34, 423; 428/689, 428/697

[56] References Cited

U.S. PATENT DOCUMENTS

| | | | |
|---|---|---|---|
| 2,943,951 | 7/1960 | Haglund et al. | 427/423 |
| 3,344,210 | 9/1967 | Silvia | 264/3 |
| 3,387,110 | 6/1968 | Wendler et al. | 219/76 |
| 3,513,044 | 5/1970 | Ishibashi | 149/87 |
| 3,523,840 | 8/1970 | Bedell | 149/19.1 |
| 3,591,759 | 7/1971 | Stand | 219/76 |
| 3,676,638 | 7/1972 | Stand | 219/121 P |
| 3,734,983 | 5/1973 | Forsten et al. | 264/3 C |
| 3,766,820 | 10/1973 | Forsten et al. | 86/23 |
| 4,092,383 | 5/1978 | Reed, Jr. | 264/3 C |
| 4,121,083 | 10/1978 | Smyth | 219/76.16 |
| 4,124,663 | 11/1978 | Brumley et al. | 264/3 D |
| 4,146,654 | 3/1979 | Guyonnet | 427/34 |
| 4,202,641 | 5/1980 | Yurasko, Jr. | 427/423 |
| 4,445,021 | 4/1984 | Irons et al. | 219/121 PM |

*Primary Examiner*—Norman Morgenstern
*Assistant Examiner*—Marianne L. Padgett
*Attorney, Agent, or Firm*—Anne D. Daniel; James H. Chafin; Judson R. Hightower

[57] ABSTRACT

A method of forming exoergic structures, as well as exoergic structures produced by the method, is provided. The method comprises the steps of passing a plasma-forming gas through a plasma spray gun, forming a plasma spray, introducing exoergic material into the plasma spray and directing the plasma spray toward a substrate, and allowing the exoergic material to become molten, without chemically reacting in the plasma spray and to thereafter impinge on the substrate to form a solid mass of exoergic material, the shape of which corresponds to the shape of the substrate.

19 Claims, 1 Drawing Sheet

PROCESS FOR FORMING EXOERGIC STRUCTURES WITH THE USE OF A PLASMA

The U.S. Government has rights in this invention pursuant to Contract No. DE-AC04-76DP00053 between the U.S. Department of Energy and Monsanto Research Corporation.

BACKGROUND OF THE INVENTION

This invention relates to methods of forming an exoergic structure from reactive exoergic materials and to exoergic structures produced by such methods. Exoergic materials and structures produced therefrom have long been known in the art. As used herein, "exoergic materials" are materials which react to release relatively large quantities of energy. Such materials contain all of the components necessary to sustain an exothermic reaction, in and of themselves. Thus, such materials can contain an oxidizing agent and an agent to be oxidized. Such materials can be ignited by suitable means to produce a conventional, self-propagating exothermic reaction and have applications as "one-shot" chemical heat sources. Such exoergic materials have been formed into shapes for instance by pressing into pellets, rings, rods or cups for use in welding applications and the like. However, many useful configurations cannot be readily achieved by pressure-forming powder mixtures because of die-shape restrictions. For example, thin-walled shapes cannot be pressed because large length-to-diameter ratios result in non-uniform densities. Accordingly, known methods of producing exoergic structures are deficient, and there has been a continuing need for improvement.

Deposition of powdered materials onto substrates by the use of plasma guns has been known for many years. Exemplary patents are U.S. Pat. Nos. 3,387,110; 3,591,759; 3,676,638; 4,121,083; and 4,146,654. It is to be noted that many of these patents relate to plasma flame-spraying which is entirely nonanalogous to plasma spraying per se.

Although such plasma spraying techniques exist, conventional wisdom in the art dictates that such techniques cannot be used in the formation of exoergic structures since exoergic materials would be expected to react violently, releasing large quantities of energy, in the plasma.

SUMMARY OF THE INVENTION

It is accordingly an object of this invention to provide a method for producing exoergic structures from exoergic materials by the use of a plasma spray wherein the exoergic materials are not reacted in the plasma. It is another object of this invention to produce such exoergic structures of various shapes. It is a further object of this invention to provide exoergic structures made by such processes.

Upon further study of the specification and appended claims, further objects and advantages of this invention will become apparent to those skilled in the art.

According to one aspect of this invention, the foregoing objects are obtained by providing a method of forming an exoergic structure from reactive exoergic material comprising introducing the reactive exoergic material into a plasma spray directed toward, but not impinging on, a substrate, melting without chemically reacting the reactive exoergic material, Whereby the molten exoergic material impinges on the substrate, cools, and takes a shape which corresponds to the shape of the substrate.

In another aspect of this invention, these objects are obtained by providing exoergic structures produced by such a method.

BRIEF DESCRIPTION OF THE DRAWINGS

Various other objects, features, and attendant advantages of the present invention will be more fully appreciated as the same becomes better understood when considered in connection with the accompanying drawings, in which like reference characters designate the same or similar parts throughout the several views, and wherein.

DETAILED DISCUSSION

Figure 1:
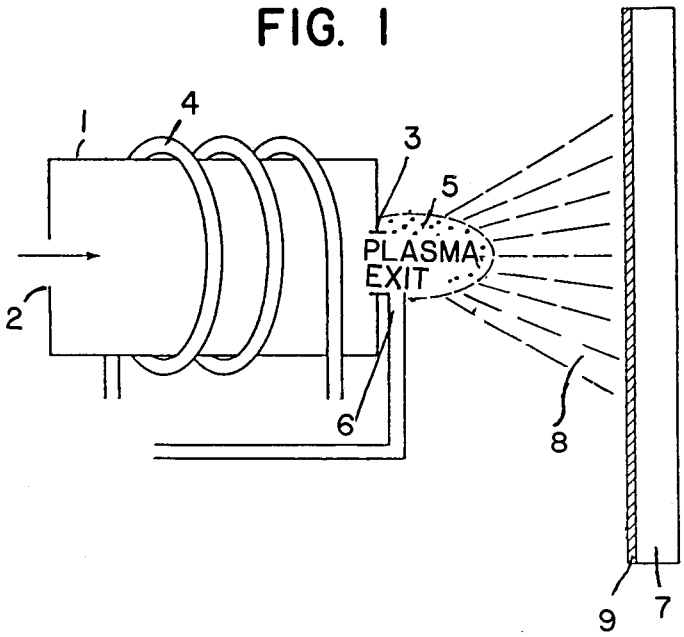
FIG. 1 is a schematic representation of a system for practicing the method of this invention.

In the system of FIG. 1, a plasma spray gun, designated generally as 1, is employed. The gun includes an inlet generally designated as 2 for a plasma-forming gas and an outlet generally designated as 3. The outlet comprises a plasma spray outlet which is fully conventional. The plasma spray gun includes fully conventional means for subjecting the plasma-forming gas to an amount of energy sufficient to form a plasma. This is accomplished by the use of fully conventional electrodes (not shown) and/or a radio-frequency coil 4. The electrodes are preferably positioned such that one is positioned downstream in the region of gas flow and the other is positioned upstream therein. When the plasma-forming gas is subjected to sufficient energy to form a plasma, the plasma exits the nozzle of the plasma spray gun and forms a plasma spray region 5. Reactive exoergic material can be introduced anywhere in the gas flow, e.g., at inlet 2, etc. Preferably, the exoergic material is introduced in the plasma spray region at 6 by suitable means, e.g., a powder feed nozzle (not shown). The substrate or target 7 is positioned downstream of the plasma spray region.

In operation, suitable plasm-forming gas is introduced into the inlet of the plasma spray gun and is passed through the gun until it exits the plasma spray nozzle. The electrodes and/or radio-frequency coil are energized to initiate the plasma formation and form the plasma spray region. Exoergic material in finely divided particulate form is then introduced into the plasma spray region. In this region, the exoergic material becomes molten without chemically reacting and is propelled toward the substrate by the plasma flow. After exiting the plasma flow region, the molten particles 8 continue toward the substrate as a result of inertia and gas flow until they impinge on the substrate and solidify. The solidified particles 9 form a self-supporting, exoergic structure.

Any reactive exoergic material can be employed. Pyrotechnic or thermite materials are preferred. Suitable materials include mixtures fo $Fe_2O_3$ and Mg, $Fe_2O_3$ and Al, Zr and CuO, Zr and $Fe_2O_3$, Mg and chromium oxides, Al and chromium oxides, Zr and chromium oxides, and Nio and Al. Especially preferred are mixtures of aluminum and $Fe_2O_3$, mixtures of aluminum and $Cu_2O$, and mixtures of titanium and boron. Preferred particle sizes are in the range of from 220 to 325 mesh. Feed rates of such powders are typically 40–60 grams per minute, preferably 45–48 grams per minute.

Suitable plasma-forming gases include argon and helium. Oxidizing gases such as oxygen are not acceptable. Argon is a preferred plasma-forming gas. Gas feed rates are typically 40–60 cubic feet per hour.

The electrodes of the plasma torch require 350 amperes at 48 volts. The temperature of the plasma is typically 15,000°–30,000° C. The total system can be in an ambient pressure environment or in a slight vacuum environment.

The particles are typically fed into the hot region of the plasma. The powders melt in the plasma without any apparent chemical reaction and are transported by the gas flow in the plasma onto a target substrate which preferably is 3 inches from the edge of the plasma. Upon contact with the relatively cool surface of the target substrate, the molten powders very rapidly solidify to a dense structure. Although the known reaction ignition temperatures of the above-identified exoergic mixtures are lower than either the typical temperatures of the plasma or the known melting points of the constituents of the mixtures, no reaction occurs because the dwell time of the powders in the plasma region is extremely short. Typical dwell times are on the order of a few microseconds, for insance not more than 500 microseconds. The dwell times must be long enough for the powders to melt but short enough so that no reaction occurs. Preferably, the plasma conditions are such that minimum particle-to-particle contact occurs, which contributes to the melting of the powder without chemical reaction .

Thin-walled, rigid, high-density exoergic structures of various geometries result. Typical wall thicknesses of the resulting structures are 0.040 inch, although wall thicknesses can range from a few thousandths to ¾ of an inch.

The substrate can be formed of any suitable material. Particularly suitable are graphite and polytetrahalogenated compounds, e.g., polytetrahaloethylene (teflon). The choice of shapes of the substrate is unlimited. Thus, targets can be in the form of flat plates, spheres, or any other shape. The orientation of the target in relation to a conventional argon plasma device is shown in FIG. 1. The mildness of the process has been demonstrated by plasma spraying powders onto an empty egg shell to produce a satisfactory structure of corresponding shape.

The target substrate can be readily separated from the fused structure so that the exoergic structure can be isolated for later use. Alternatively, the exoergic material can be left on the substrate as an integral part. Such a composite is particularly suitable as a welding composite which can be conventionally ignited at a later time to cause joining by thermitic fusion.

In addition, the surface of the exoergic structure can be plasma sprayed with insulative and protective coatings An insulator such as $ZrO_2$ can be used to direct the heat flow during the thermitic reaction, and various metals can be applied as protective coatings.

Figure 2:
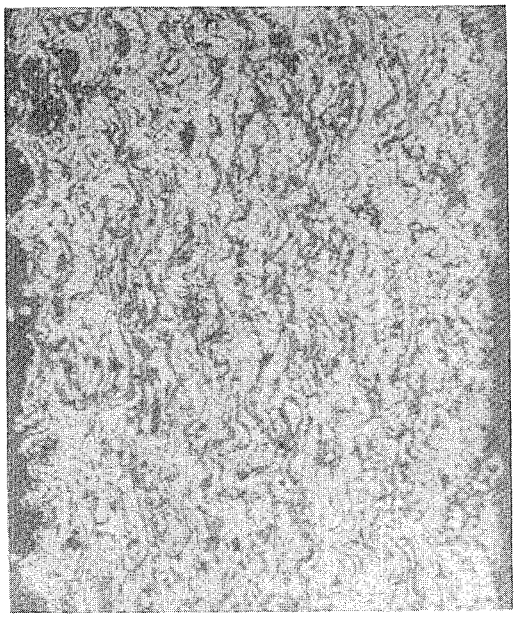
FIG. 2 discloses the microstructure of a typical plasma-formed part formed by a process of this invention.

The microstructure of a typical plasma-formed part is shown in FIG. 2. The interconnecting matrix resulted when molten Al and $Fe_2O_3$ particles hit the target and solidified. The white Al stringers interconnecting with the dark $Fe_2O_3$ stringers form a strong, continuous laminar matrix.

Figure 3:
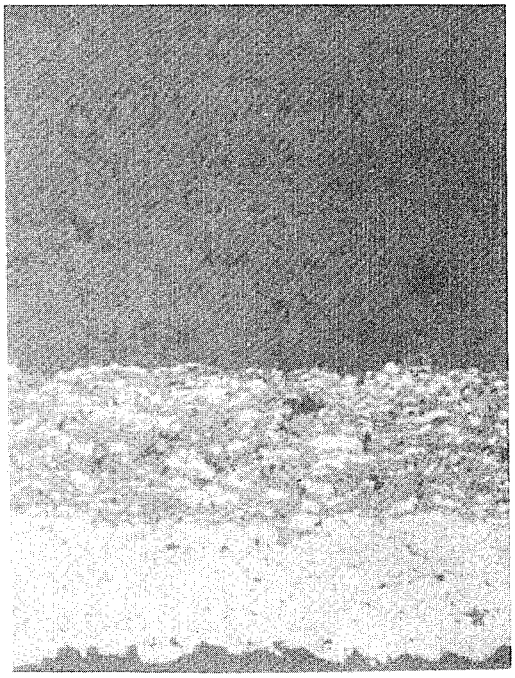
FIG. 3 shows the cross-section of a plasma-formed $Al/Fe_2O_3$ thermite sandwiched between a layer of $ZrO_2$ on the top and a layer of 304 stainless steel on the bottom.

In addition to $ZrO_2$, metals can also be plasma sprayed on the surface of the exoergic structure to form a protective coating. Additionally, the powders can be diluted with a diluent, e.g., $ZrO_2$. The micrograph in FIG. 3 shows the cross section of a plasma-formed $Al/Fe_2O_3$ thermite sandwiched between a layer of $ZrO_2$ on the top and a layer of 304 stainless steel on the bottom. A continuous, uniform interface can be seen in this micrograph. Demonstrations have shown that thermite can be plasma formed to any desired shape, and coated for protection or for heat flow control.

Without further elaboration, it is believed that one skilled in the art can, using the preceding description, utilize the present invention to its fullest extent. The following preferred specific embodiments are, therefore, to be construed as merely illustrative, and not limitative of the remainder of the disclosure in any way whatsoever.

In the preceding text and the following examples, all temperatures are set forth uncorrected in degrees Celsius and all parts and percentages are by weight, unless otherwise indicated.

EXAMPLE 1

An exoergic structure was formed using a conventional plasma spray gun. Argon gas was introduced into the plasma spray gun at the rate of 40 standard cubic feet/hour. A current of 60–80 amps was applied to the electrodes of the gun to form a plasma directed to, but not impinging upon, a substrate. Aluminum and $Fe_2O_3$ having a particle size between 270 mesh and 325 mesh were simultaneously introduced into the plasma feed gas at a gas flow rate of 10–45 standard cubic feet/hour. A shaped exoergic structure was formed on the substrate.

EXAMPLE 2

The procedure of Example 1 was carried out using helium as the plasma-forming gas which was fed into the plasma spray gun at a rate of 75–125 standard cubic feet/hour.

EXAMPLE 3

The procedure of Example 1 was followed. The substrate was a steel article and the exoergic material was sprayed onto a flat surface thereof. A second steel member was placed on top of the face of the first member on which the exoergic material was plasma-sprayed. The exoergic material was then ignited. A weld between the two steel members resulted.

The preceding examples can be repeated with similar success by substituting the generically or specifically described reactants and/or operating conditions of this invention for those used in the preceding examples.

From the foregoing description, one skilled in the art can easily ascertain the essential characteristics of this invention and, without departing from the spirit and scope thereof, can make various changes and modifications of the invention to adapt it to various usages and conditions.

What is claimed is:

1. A method of shaping a reactive exoergic material, comprising:

(a) introducing an oxygen-free plasma-forming gas into a plasma spray;

(b) introducing said reactive exoergic material in finely divided particulate form into said plasma spray directed toward, but not impinging on, a substrate;

(c) melting, without chemically reacting, said reactive exoergic material in the plasma; and (d) impinging said molten reactive exoergic material on said substrate to form a reactive exoergic shape which corresponds to the shape of said substrate.

2. A method of claim 1, wherein the temperature of said plasma is from about 15,000° to about 30,000° C.

3. A method of claim 1, wherein said reactive exoergic material is a mixture of Al and $Fe_2O_3$.

4. A method of claim 1, wherein said reactive exoergic material is a mixture of Al and $Cu_2O$.

5. A method of claim 1, wherein said reactive exoergic material is a mixture of Ti and B.

6. A method of claim 3, wherein said mixture is diluted with zirconia.

7. A method of claim 4, wherein said mixture is diluted with zirconia.

8. A method of claim 5, wherein said mixture is diluted with zirconia.

9. A method of claim 1, wherein said gas is introduced into said plasma spray at a rate of from about 40 to about 60 $ft^3/hr$.

10. A method of claim 1, wherein said reactive exoergic material is introduced at the rate of from about 40 to about 60 grams/minute.

11. A method of claim 10, wherein said reactive exoergic material is introduced at the rate of from about 45 to about 48 grams/minute.

12. A method of claim 1, wherein said substrate comprises graphite.

13. A method of claim 1, wherein said substrate comprises a polytetrahaloethane.

14. A method of claim 1, wherein said reactive exoergic material is a thermite material.

15. A method of claim 1, wherein said reactive exoergic material is a pyrotechnic material.

16. An article comprising a solidified mass of exoergic material produced by the process of claim 1.

17. An article comprising a solidified mass of exoergic material produced by the process of claim 3.

18. An article comprising a solidified mass of exoergic material produced by the process of claim 4.

19. An article comprising a solidified mass of exoergic material produced by the process of claim 5.

* * * * *